United States Patent [19]

Quinan

[11] 4,231,498

[45] Nov. 4, 1980

[54] CORROSION-RESISTANT CRUCIBLE WITH GRAPHITE PARTS

[75] Inventor: James R. Quinan, Loudonville, N.Y.

[73] Assignee: Albany International Corp., Menands, N.Y.

[21] Appl. No.: 956,508

[22] Filed: Nov. 1, 1978

[51] Int. Cl.[3] ..... B22D 39/00; B22D 41/10

[52] U.S. Cl. ..... 222/602; 222/149

[58] Field of Search ..... 222/149, 504, 559, 591, 222/597, 598, 602, 629; 164/336

[56] References Cited

U.S. PATENT DOCUMENTS

| | | | |
|---|---|---|---|
| 1,832,873 | 11/1931 | Milner | 222/597 X |
| 3,628,706 | 12/1971 | Todd | 222/591 |
| 4,073,414 | 2/1978 | Garab | 222/602 |

*Primary Examiner*—David A. Scherbel

*Attorney, Agent, or Firm*—Kane, Dalsimer, Kane, Sullivan & Kurucz

[57] ABSTRACT

A device for metering and transferring liquid metals. It includes a supporting structure and, a hollow sleeve on the supporting structure open at both ends. A pouring spout is on one end and has an orifice therethrough communicating with the hollow interior of the sleeve. A stopper rod extends into the sleeve from the other end thereof to be shiftable between a position seating on the pouring spout and sealing the orifice therein at a position removed from the pouring spout to permit liquid metal to flow into and out of the sleeve. At least a portion of the stopper rod which seats on the pouring spout and the portion of the pouring spout in engagement with the stopper rod are formed of graphite material. Other portions of the device are formed of a ni-resist alloy with a layer of oxide formed on those surfaces of the ni-resist alloy which are brought into contact with the liquid metal to increase the chemical resistance of those surfaces to the liquid metal being metered and transferred.

20 Claims, 4 Drawing Figures

CORROSION-RESISTANT CRUCIBLE WITH GRAPHITE PARTS

BACKGROUND OF THE INVENTION

In dealing with the transferring of liquid metals from a furnace by means of a crucible or ladle, there are a number of potential difficulties. One common type of problem deals with handling of certain metals, particularly aluminum. Molten alumninum is very reactive chemically and therefore very corrosive to metal containers. To combat this problem metal containers or crucibles are occasionally replaced by ceramic or refractory formed or lined components. The difficulty that occurs with this type of structure is that ceramic or refractory components are brittle and easily broken upon impact. Also, some are subject to thermal shock and when they are used with metal, allowance must be provided for low thermal expansion. Accordingly, it is desirable where possible to use metal crucibles or ladles to handle, transport and meter liquid metals. In fact, one type of successful crucible for this purpose is depicted and described in U.S. Pat. No. 4,073,414. The type of structure in that reference has proved to be extremely variable and useful in overcoming many problems in the liquid metal handling field.

Further improvements are desirable particularly when working with molten metals such as aluminum. If an unalloyed grey iron is used for the crucible surface, scale will form after exposure to sufficiently high temperatures. The scale formed in air consists of a mixture of iron oxides. The important factor in scale formation is whether the scale is adherent to the base metal and thus prevents further oxidation, or whether it flakes off permitting further and continuous oxidation of the base metal. In environments subject to a high degree of oxidation this consideration is of great concern.

One solution to the oxidation problem has been to provide a crucible formed of oxidized ni-resist, that is a nickel containing iron. The finished parts of the crucible to be contacted by the molten metal such as liquid aluminum are oxidized prior to use by forming an adherent layer of oxide which is more resistant chemically than the original metal. Therefore, since molten aluminum is reactive chemically, and therefore very corrosive to metal containers, the resistance to corrosion of the ultimate crucible is greatly enhanced.

Silicon and chromium increase the scaling resistance of cast iron by forming a thin surface oxide that resists further oxidation. These elements also reduce the toughness and thermal shock resistance of cast irons. The presence of nickel serves to improve the scale resistors of most alloys containing chromium and, in addition, increases the toughness and strength at elevated temperatures.

The corrosion resistance of grey iron is improved by the addition of appreciable amounts of chromium, nickel and copper, singly or in combination. Nickel irons have been chosen for crucible construction to obtain a combination of corrosion resistance, high temperature toughness and adherent oxidation resistant scale formation.

In dealing with the highly acceptable crucibles formed of ni-resist alloy with a layer of oxide thereon, eventually the oxide could wear off and consequently expose the worn surfaces to the corrosive molten metal such as aluminum. This condition would be particularly prevalent where there is interengagement between surfaces and frictional action between those surfaces. For example, this could occur where an aperature in the crucible is repeatedly opened and closed.

SUMMARY OF THE INVENTION

Consequently, it is a primary objective of the present invention to provide improved anti-corrosion protection in areas of high wear. In the crucible of the type under consideration and as disclosed in the above reference patent there is an opening and closing relationship and accordingly a seating action between the stopper rod and the pouring spout of the assembly. Surfaces of both are brought into the repeated interengagement which could eventually cause an oxide layer to wear off and consequently expose the worn surfaces to the corrosive molten metal such as aluminum.

An objective of the present invention is to provide a pouring spout and stopper rod made from graphite at least in the areas of interengagement. These surfaces are more resistant to the corrosive action inside the crucible than the oxidized ni-resist alloy material of the crucible. This is an unexpected result because normally graphite should oxidize at approximately 1000° F. and consequently rapidly powder and flake away. However, because of the low level of air in the crucible this does not occur.

A further objective of the invention is to provide the exposed parts of the graphite rod and pouring spout portions which come into contact with air outside the crucible with a coating of a ceramic type of paint to effectively reduce the corrosion of those portions of the structure.

More specifically, the object of the present invention includes the provision of crucible components used for pouring molten aluminum which are made of oxidized ni-resist and graphate. The exterior structure is constructed from oxidized ni-resist to give the unit strength while the pouring spout and stopper rod entirely or only the contacting portions thereof are made from graphite.

In an oxidizing atmosphere the temperature wanted for the use of graphite is usually set to be around 1000° F., because it is a form of carbon, and is subject to oxidation. In the present invention, a graphite stopper rod and pouring spout can be used for pouring aluminum and other corrosive metals at 1250° F. because there apparently is only a small amount of air circulation inside the crucible. The top part of the stopper rod which is above the level of the molten metal and closest to the top opening of the crucible does undergo slow oxidation, making this part of the rod chalky, where it eventually becomes thinner. The lower portion of the stopper rod and the inside of the graphite pouring spout remain hard and sound.

The outside of the pouring spout which is reciprocated into and out of the molten metal and exposed to air, also oxidizes in time. The useful life of the pouring spout and stopper rod can be extended by coating the outside of the pouring spout and the top portion of the stopper rod with a ceramic type paint, which in effect reduces the exposure of these hot areas to the atmosphere.

In summary, a device is provided for metering and transferring liquid metal. It includes a supporting structure, a hollow sleeve on the supporting structure with the hollow sleeve being open at both ends. A pouring spout is on one end and has an orifice therethrough communicating with the hollow interior of the sleeve. A stopper rod extends into the sleeve from the other end thereof to be shiftable between a position seating on the pouring spout and sealing the orifice therein and a position removed from the pouring spout to permit liquid metal to flow into and out of the sleeve. Means is provided for shifting the stopper rod between positions. At least the portion of the stopper rod seating on the pouring spout and the portion of the pouring spout and engagement therewith are formed of graphite.

With the above objective among others in mind, reference is made to the attached drawings.

DETAILED DESCRIPTION

The metal ladle or crucible 20 of the present invention is designed particularly for use in a metal casting apparatus of a conventional nature. The general structure of device 20 is similar to that disclosed in U.S. Pat. No. 4,073,414 mentioned above, and the contents of that reference are incorporated herein by reference.

Figure 1:
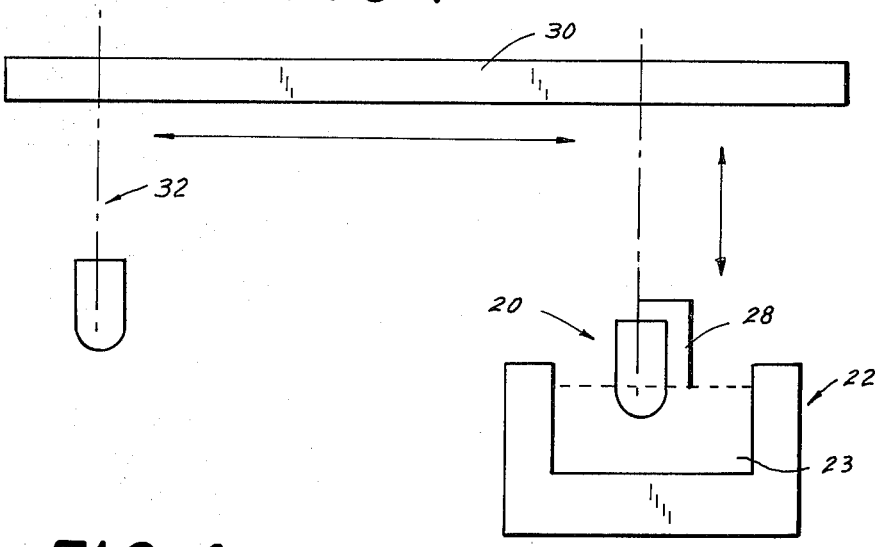
FIG. 1 is a schematic representation of the device of the invention shown as part of a casting apparatus.
Figure 4:
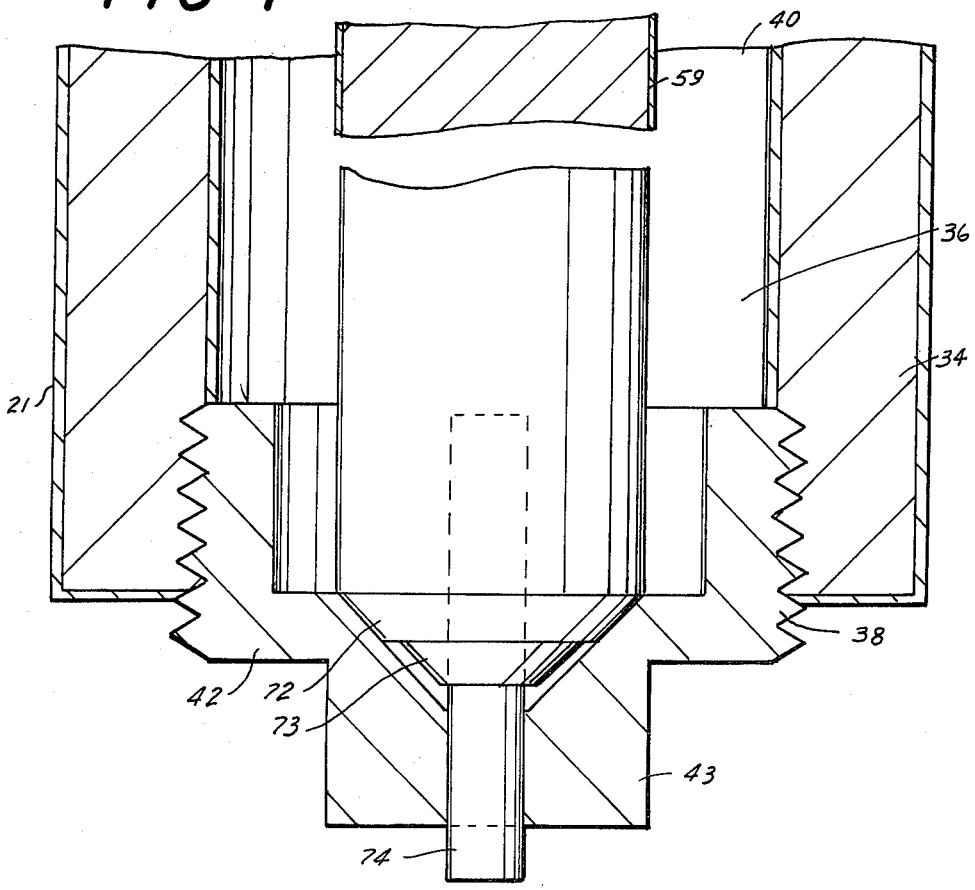
FIG. 4 is an enlarged partially sectional view of the device with the parts in position closing the orifice in the pouring spout.

The crucible device 20 of the present invention is designed particularly for use in handling highly corrosive metals such as molten aluminum. An appropriate furnace 22 is provided with a central chamber to hold the molten metal 23 which has been heated to liquid form. Furnace 20 is depicted in FIGS. 1 and 4 with a predetermined amount of molten aluminum 23 positioned therein.

The crucible or ladle device 20 is reciprocally movable into and out of the open top of the furnace and accordingly into and out of the molten metal 23. A probe 28 is used to control the depth of the crucible within the furnace.

The crucible is connected to an over-head guideway and support structure 30 which serves to guide and support the crucible after it has been removed from the furnace and delivered to a further work station such as pouring station 32 whereupon the metal shot contained in the ladle is released into a mold cavity or a shot well.

Crucible 20 is formed of ni-resist, a class of alloy irons containing at least 13% nickel as discussed above. In order to increase the resistance of this material to the corrosive attack of the molten aluminum or similar metal, an adherent layer of oxide is formed on the surface, which by its nature is less chemically reactive than the metal itself. Also, as discussed above, this is accomplished by heating the finished component to approximately 1000°–1250° F. in a normal or oxidizing atmosphere slowly, and allowing the component to cool slowly in the furnace or in air.

Molten aluminum is very active chemically, and therefore very corrosive to metal containers. By oxidizing the finished parts prior to use, an adherent layer of oxide is formed which is more resistant chemically than the original metal.

The seating action of the stopper rod on the pouring spout of crucible 20 over a period of time could cause the oxide layer to wear off and consequently expose the worn surfaces to the corrosive molten metal. Therefore, it has been found effective to form the pouring spout and stopper rod of graphite material which is more resistant to the corrosive action inside the crucible than the oxidized ni-resist. This is an unusual and unexpected result because the graphite should oxidize at approximately 1000° F. and consequently rapidly powder and flake away. But, because of the low level of air within the crucible this does not occur. The parts of the rod and plug which are exposed to air outside the crucible, are coated with ceramic-type paint to effectively reduce the corrosion.

Turning to the operating components of crucible 20, a cast iron sleeve 34 is provided and is hollow to form an inner shot chamber 36. The sleeve has an open bottom end 38 and an open top end 40 and both of the open ends have a threaded inner surface for coupling to other components. At bottom end 38 a graphite pouring spout 42 with a threaded outer surface is coupled with the sleeve to close off the bottom end. A central orifice 44 is provided in the pouring spout for passage of the molten metal clear through into an outer chamber 36 in the sleeve. The upper end 46 of orifice 44 is chamfered or beveled to facilitate the sealing process in opening and closing the orifice. In the depicted embodiment the entire pouring spout 42 is formed of graphite and its surface exposed to atmosphere is covered with a protective layer of paint 43. Alternatively, the pouring spout could be formed with a graphite portion at the contact area and a protective metal such as ni-resist iron with an oxide layer in the non-coated and exposed area.

Threadedly interengaged with the upper inner surface of sleeve 34 is a connecting nipple 48 which has a threaded lower end to couple with the sleeve and also has a threaded upper end for threaded interengagement with a threaded aperature 50 and a horizontal supporting plate 52. The supporting plate is mounted to a pair of opposing upright supports 60 which are interconnected with a top plate 62. The top plate is in connection with the main top supporting structure 64 which extends into conventional interconnection with the guideway 30.

Graphite stopper rod 58 is coupled at its upper end by a conventional coupler 66 to the drive shaft 68 of a drive means 70. The upper end of stopper rod 58 is coated with a layer of protective paint 59 in the area where exposure and atmosphere can be expected. Alternatively, the stopper rod 58 can be formed partially of graphite at the lower resting end and partially of a protective metal such as ni-resist iron with an oxide outer layer at the upper end. The drive means is conventional and is designed to vertically reciprocate stopper rod 58 and to rotate the stopper rod a predetermined amount of turn after seating. A turn of approximately 90 degrees has been found to work effectively.

A conventional main drive mechanism is utilized to lift the entire device 20 and the interconnected supporting structure described above upward and to lower it accordingly in connection with furnace 22.

Stopper rod 58, which may be segmented by optional coupling 65 to provide height adjustment and facilitate the removal and replacement of the tip end, has a beveled or a chamfered surface 72 connected to a beveled transition segment 73 adjacent its elongated tip 74. When the rod 58 is in the full downwardly extended position its chamfered lower end 72 mates with a portion of the chamfered portion 46 of orifice 44 in the pouring spout to form a sealing interengagement therewith and close the orifice. The total length of transition segment 73 and tip 74 is slightly longer than the remainder portion of orifice 44 and therefore at the same time extends beyond the bottom end of the pouring spout. Additionally, tip 74 is of slightly less diameter than orifice 44 providing a slight clearance therebetween.

Figure 2:
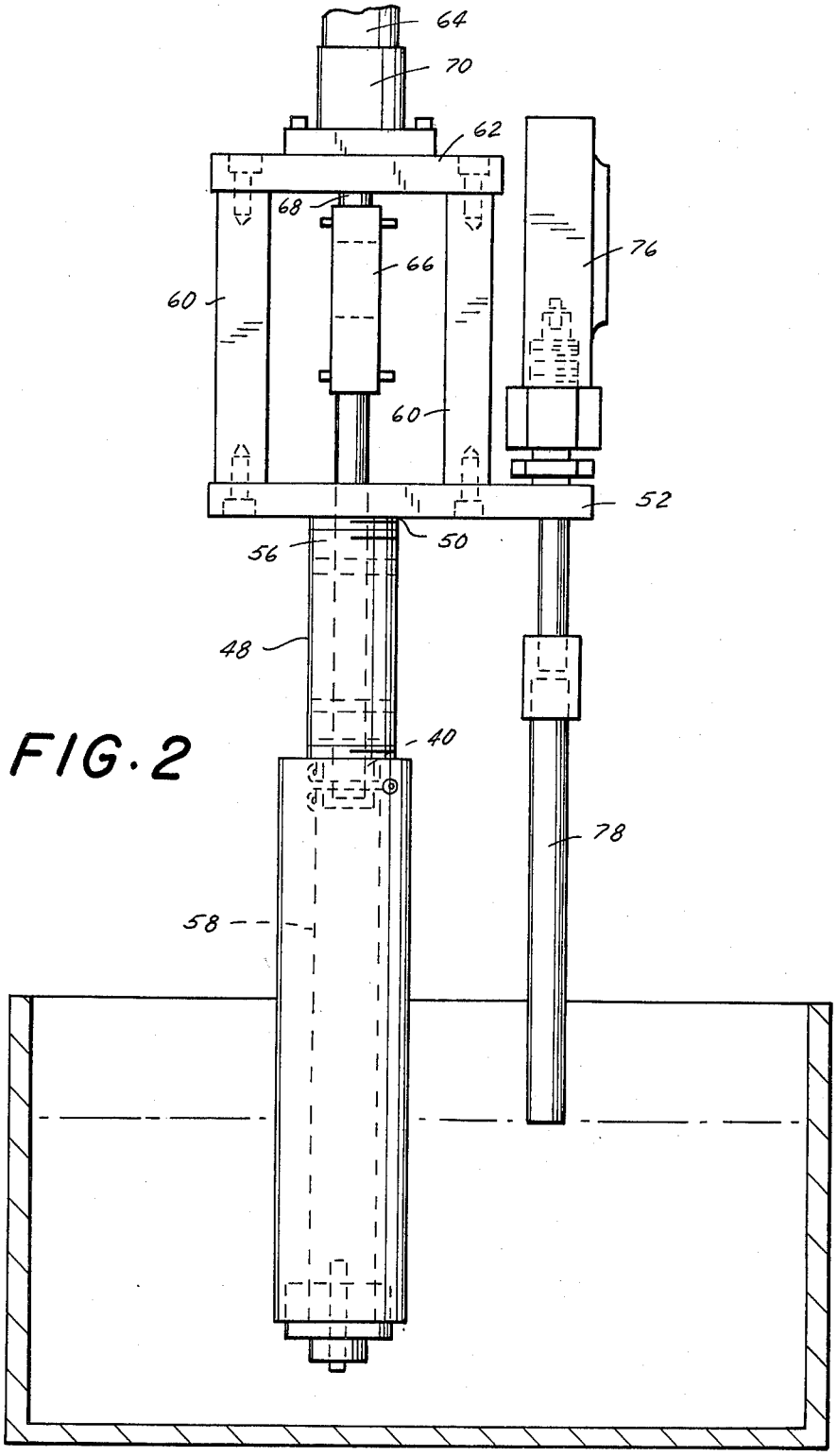
FIG. 2 is an enlarged partially sectional elevation view of the device of the invention shown positioned in a furnace and containing molten metal.
Figure 3:
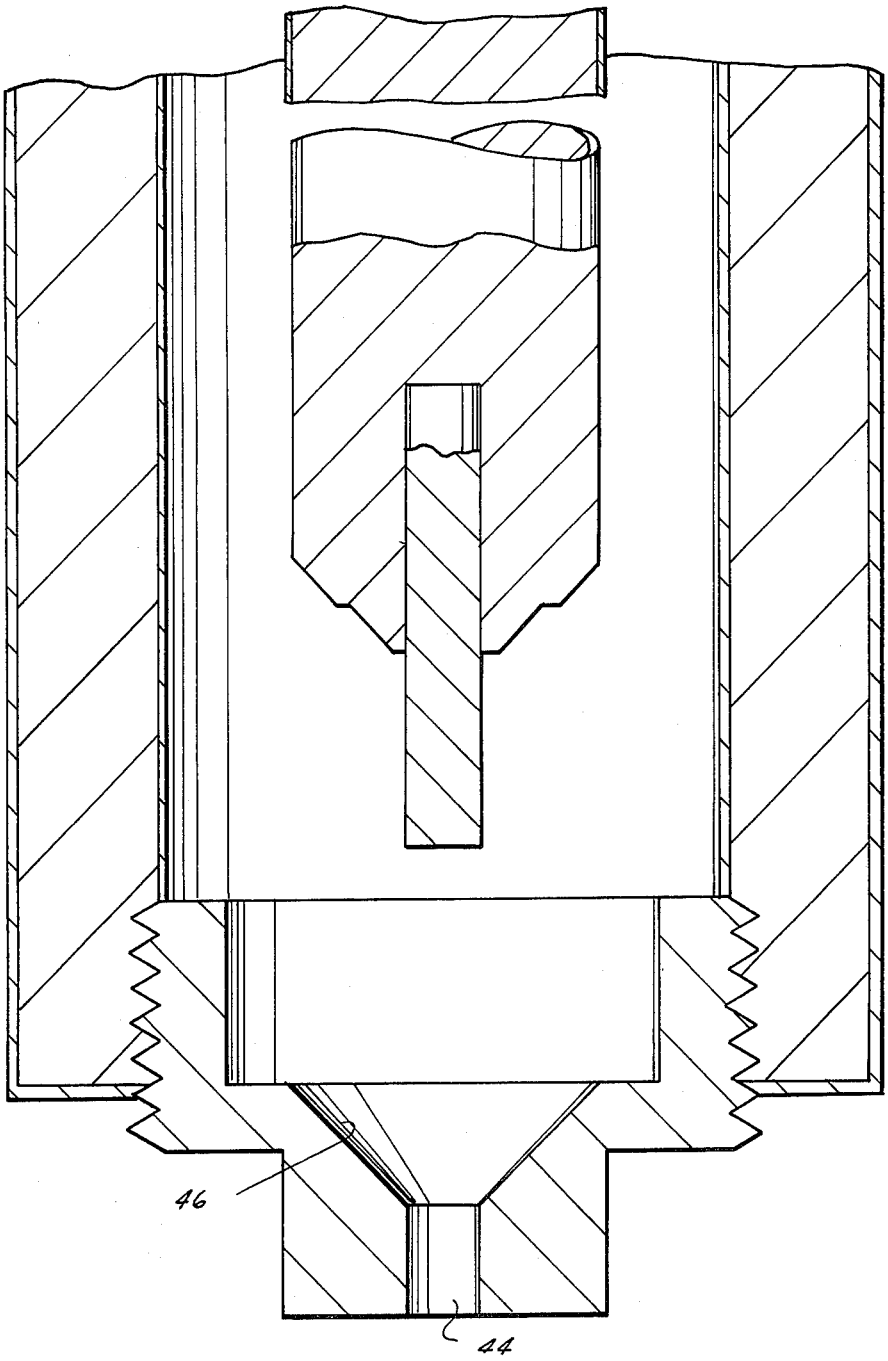
FIG. 3 is an enlarged partially sectional view of the device with parts in position for metal to flow into and out of the orifice in the pouring spout.

A probe support 76 is aligned with an upright support 60 and is interconnected therewith by a laterally extending arm 78. This spaces the probe support 76 laterally from the ladle and permits the vertical extension of a probe downward to the surface of the molten metal. Probe 78, a conventional conductor, is utilized to determine electrically its contact with the molten metal, and consequently regulate the depth of the immersion of the ladle into the molten metal. In use, the components of the ladle are in the position as depicted in FIG. 2, initially. Tip 74 is housed in pouring spout orifice 44 and a sealing interengagement exists between the beveled or chamfered graphite portions 72 and 46. The ladle is guided into alignment with the furnace 22 and the main drive structure is actuated to lower the ladle into the molten metal 23 in the furnace 22 until probe 78 makes contact with the metal and thereby signals for the cessation of the vertical downward movement of the ladle. As the ladle enters the molten metal it passes through a layer of dross or slag at the top surface thereof. The presence of the tip extending beyond the lower end of orifice 44 substantially prevents entry of the slag or dross into the orifice thereby protecting the opening into the chamber 36.

When the ladle is at the submerged downward filling position, the actuator mechanism 70 is automatically activated to lift stopper rod 58 upward. The molten metal 23 then passes through orifice 44 into the chamber 36 to the predetermined height at which the stopper rod 58 is lowered to close orifice 44. Since the pouring spout is below the slag level there is no introduction of slag or dross into the chamber. In this manner, the desired shot of molten metal is contained within the ladle.

Actuator 70 is then activated to drive the stopper rod 58 downward and then rotate the stopper rod after seating into its initial position. The rotating action helps effect the seal between chamfered graphite surface 72 and 46. A hydraulic pump can be provided as part of the drive mechanism 70 for the stopper rod to exert a slight pressure on the rod in the downward direction and further effect a positive seal between the chamfered graphite surfaces and prevent any leakage of metal from the chamber 36.

The main drive mechanism is then activated to lift the ladle and supporting structure out of the furnace. As this occurs, the presence of tip 74 prevents collection of dross 26 within orifice 44 in the same manner as it prevented such collection in the downward movement in the furnace. Additionally, there is slight clearance between tip 74 and orifice 44 so that any excess metal can drip out of the bottom of the pouring spout as the ladle is lifted.

Once the ladle is removed from the furnace 22, the main drive mechanism traverses the ladle and supporting structure to the pouring station 32 at which time the stopper rod will be again activated by mechanism 70 and will be vertically lifted to open orifice 44 and permit the shot of metal within chamber 36 to pour orifice 44 into a shot well or mold. In this manner, accuracy of the orifice opening 44 is maintained throughout an extended period of time. Furthermore, the chance of dross being entrained in the molten metal shot exiting from chamber 36 is minimized and in most cases completely eliminated. Consequently, a pure charge of molten metal is introduced into the mold.

The procedure is then repeated with the main drive mechanism which is, as described above, a hydraulically actuated cylinder that traverses the ladle back to the furnace for a repeat procedure. Appropriate timing mechanisms (not shown) can be provided to determine the time for each step in the procedure.

Central opening 56 is provided on the top of the ladle to permit gases to escape at high velocity including the forcing of air out through the upper end of the ladle. At the same time, the high velocity movement of gases out of the ladle will serve to substantially deter and in most cases prevent air from reentering through the top of the ladle and reacting with the molten metal. Appropriate safeguards against leakage are provided including the provision of the rotational movement in seating chamfered surface 72 on chamfered surface 46, by providing a seating pressure on stopper rod 58, such as 50 psi, and by providing the chamfered seating areas at the point of seal. Also, easy removal and replacement of the rod and spout can be accomplished with the present structure whenever desired. This action is minimized due to the graphite material used to form the chamfered surfaces on the stopper rod and the pouring spout in the manner described above.

Repeated metering accuracy is obtained by maintaining a constant size orifice in the spout. Orifice size change may be the result of wear between rod tip 74 and spout 42 or metal and dross build up on the same parts. Wear is controlled by providing a somewhat larger diameter to orifice 44 in the spout 42 than the diameter of rod tip 74. The rotary motion of tip 74 also guards against build up upon each lowering of the rod. Further, the diameter differential between the tip 74 and orifice 44 permits drainage below the chamfered seal of the liquid metal back into the furnace upon removal of ladle 20.

Decreased dross formation in the ladle is accomplished by air, which is necessary to form dross, being forced, by the hot gases emanating from the molten metal, through the clearance between opening 56 and rod 58. Return of air is primarily prevented by the rapid cycle of operation.

Decreased dross entrainment in the liquid metal results from providing the tip 74 with sufficient length to extend at the bottom end of spout 42 when the ladle is lowered into the furnace 22 thereby preventing a pick-up of dross 26 from the top of the liquid metal 23. Rod 58 is lifted only after spout 42 is below the dross level and closed again before the ladle 20 is removed from the furnace 22.

All of the components of crucible or ladle 20 which come in contact with the liquid metal are formed of a ni-resist material with an oxidized layer 21 with the exception of at least the portions of the stopper rod and the pouring spout which form the interengaging chamfered surfaces sealing the bottom of the ladle. In this manner, the resistance to corrosion is increased during repeated use of the crucible 20. Thus, the present invention is particularly useful in handling highly corrosive liquid metals such as aluminum.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A device for metering and transferring liquid metals comprising; a supporting structure, a hollow elongated sleeve on the supporting structure and open at both ends, a pouring spout on one end and having an orifice therethrough communicating with the hollow interior of the sleeve, a stopper rod extending into the sleeve from the other end thereof and forming a passage with the open other end of the sleeve for the escape of gases from liquid metal contained within the sleeve, the stopper rod to be shiftable between a position seating on the pouring spout and sealing the orifice therein and a position removed from the pouring spout to permit liquid metal to flow into and out of the sleeve, means for shifting the stopper rod between positions, at least the portions of the stopper rod and pouring spout which seat to seal the orifice being formed of graphite material, and a tip extending from the stopper rod into the orifice when in the seated position to facilitate isolation of the graphite portions from atmosphere.

2. The invention in accordance with claim 1 wherein the entire stopper rod and pouring spout are formed of graphite material.

3. The invention in accordance with claim 1 wherein the device is a crucible and the remaining portions of the crucible other than the graphite portions being formed of ni-resist alloy oxidized by the formation of an adherent layer of oxide thereon to increase the chemical resistance of the exposed surfaces thereof.

4. The invention in accordance with claim 3 wherein the ni-resist alloy is taken from a class of alloy iron containing at least 13% nickel.

5. The invention in accordance with claim 4 wherein the ni-resist alloy is a nickel iron containing approximately 13–18% nickel, up to approximately 5.5% chromium, approximately 3% silicon and approximately 7% copper.

6. The invention in accordance with claim 3 wherein the layer of oxide on the ni-resist alloy is formed by heating the surfaces thereof to approximately the range of 1000°–1250° F. in an oxidizing atmosphere slowly, and thereafter allowing the heated parts to cool slowly.

7. The invention in accordance with claim 1 wherein any graphite portion exposed to a greater amount of air than the limited exposure is coated with ceramic-type paint to effectively reduce the corrosion.

8. The invention in accordance with claim 1 wherein the stopper rod and pouring spout have mating graphite surfaces thereon to facilitate sealing engagement therebetween when the stopper rod is in the seating position, the means for shifting the stopper rod between positions including axial drive means and rotary drive means to permit the stopper rod to be rotated with respect to the pouring spout and sleeve and to be axially shifted with respect to the pouring spout and sleeve and operating so that when the stopper rod is directed into mating engagement with the pouring spout it will be both axially and rotatably brought into mating engagement thereby facilitating sealing of the stopper rod and pouring spout.

9. The invention in accordance with claim 8 wherein transfer means transfers the device into and out of a container of liquid metal with the stopper rod being in the seated position on the pouring spout during insertion into the liquid metal to facilitate prevention of accumulation of undesirable material within the hollow sleeve during the insertion into the liquid metal to the desired depth, means for cleaning the orifice and for preventing undesirable materials from collecting in the orifice including the end of the stopper rod adjacent to the pouring spout having a smaller diameter tip portion extending therefrom of a predetermined length so that when the stopper rod is seated in sealing position on the pouring spout the tip will extend through the orifice in the pouring spout thereby guarding against the accumulation of undesirable materials in the orifice wall as the device is being transferred into a container of liquid metal, and when the stopper rod is removed from the seating position on the pouring spout the tip will be removed therefrom to permit liquid metal to freely flow through the orifice in the pouring spout and the tip acting to remove any collection of undesirable materials from the orifice upon reinsertion therein as it is rotated and axially moved with the stopper rod as the stopper rod is reseated on the pouring spout.

10. The invention in accordance with claim 1 wherein the mating surfaces between the stopper rod and pouring spout are beveled to facilitate seating engagement therebetween, the pouring spout being removably mounted on one end of the sleeve and the stopper rod being movably mounted on the support structure.

11. A method of forming a device adapted for metering and transferring liquid metal comprising; the forming of a crucible structure having an open upper end and including a pouring spout having an orifice and a stopper rod shiftable between a position seating on the pouring spout and sealing the orifice therein and a position removed from the pouring spout to permit liquid metal to flow into and out of the crucible, the space between the open upper end and the stopper rod forming a passage in the crucible structure for the escape of gases from liquid metal contained within the crucible structure, forming at least the portions of the stopper rod and pouring spout which seat to seal the orifice of graphite material, and locating a tip on the stopper rod to extend into the orifice when in the seated position to facilitate isolation of the graphite portions from atmosphere.

12. The invention in accordance with claim 11 wherein the entire stopper rod and pouring spout are formed of graphite material.

13. The invention in accordance with claim 11 wherein the device is a crucible and the remaining portions of the crucible other than the graphite portions being formed of ni-resist alloy oxidized by the formation of an adherent layer of oxide thereon to increase the chemical resistance of the exposed surfaces thereof.

14. The invention in accordance with claim 13 wherein the ni-resist alloy is taken from a class of alloy iron containing at least 13% nickel.

15. The invention in accordance with claim 14 wherein the ni-resist alloy is a nickel iron containing approximately 13–18% nickel, up to approximately 5.5% chromium, approximately 3% silicon and approximately 7% copper.

16. The invention in accordance with claim 13 wherein the layer of oxide on the ni-resist alloy is formed by heating the surfaces thereof to approximately the range of 1000°–1250° F. in an oxidizing atmosphere slowly, and thereafter allowing the heated parts to cool slowly.

17. The invention in accordance with claim 11 wherein any graphite portion exposed to a greater amount of air than the limited exposure is coated with ceramic-type paint to effectively reduce the corrosion.

18. The invention in accordance with claim 11 wherein the stopper rod and pouring spout have mating graphite surfaces thereon to facilitate sealing engagement therebetween when the stopper rod is in the seating position, the means for shifting the stopper rod between positions including axial drive means and rotary drive means to permit the stopper rod to be rotated with respect to the pouring spout and to be axially shifted with respect to the pouring spout and operating so that when the stopper rod is directed into mating engagement with the pouring spout it will be both axially and rotatably brought into mating engagement thereby facilitating sealing of the stopper rod and pouring spout.

19. The invention in accordance with claim 18 wherein the transfer means transfers the device into and out of a container of liquid metal with the stopper rod being in the seated position on the pouring spout during insertion into the liquid metal to facilitate prevention of accumulation of undesirable material within the hollow sleeve during the insertion into the liquid metal to the desired depth, means for cleaning the orifice and for preventing undesirable materials from collecting in the orifice including the end of the stopper rod adjacent to the pouring spout having a smaller diameter tip portion extending therefrom of a predetermined length so that when the stopper rod is seated in sealing position on the pouring spout the tip will extend through the orifice in the pouring spout thereby guarding against the accumulation of undesirable materials in the orifice wall as the device is being transferred into a container of liquid metal, and when the stopper rod is removed from the seating position on the pouring spout the tip will be removed therefrom to permit liquid metal to freely flow through the orifice in the pouring spout and the tip acting to remove any collection of undesirable materials from the orifice upon reinsertion therein as it is rotated and axially moved with the stopper rod as the stopper rod is reseated on the pouring spout.

20. The invention in accordance with claim 11 wherein the mating surfaces between the stopper rod and pouring spout are beveled to facilitate seating engagement therebetween, the pouring spout being removably mounted on one end of the sleeve and the stopper rod being removably mounted on the support structure.

* * * * *